United States Patent [19]

Stone et al.

[11] 4,173,729

[45] Nov. 6, 1979

[54] CATHODE-RAY TUBE HAVING A STEPPED SHADOW MASK

[75] Inventors: Robert P. Stone; Albert M. Morrell, both of Lancaster, Pa.

[73] Assignee: RCA Corporation, New York, N.Y.

[21] Appl. No.: 809,859

[22] Filed: Jun. 24, 1977

[51] Int. Cl.[2] ..... H01J 29/07
[52] U.S. Cl. ..... 313/403; 313/408
[58] Field of Search ..... 313/403, 402, 408, 416

[56] References Cited

U.S. PATENT DOCUMENTS

| | | | |
|---|---|---|---|
| 3,363,129 | 1/1968 | De France et al. | 313/408 |
| 3,923,566 | 12/1975 | Law | 313/403 X |
| 3,944,867 | 3/1976 | Kaplan | 313/403 |

*Primary Examiner*—Robert Segal
*Attorney, Agent, or Firm*—Eugene M. Whitacre; Glenn H. Bruestle; Dennis H. Irlbeck

[57] ABSTRACT

The tube includes an improved shadow mask contoured with step risers therein separating active portions of the mask. The risers are aligned with electron beam paths within the tube.

16 Claims, 10 Drawing Figures

CATHODE-RAY TUBE HAVING A STEPPED SHADOW MASK

BACKGROUND OF THE INVENTION

This invention relates to shadow mask type cathode ray tubes and, particularly to contours of shadow masks within such tubes.

In a shadow mask tube, a plurality of convergent electron beams are projected through a multiapertured color selection shadow mask to a mosaic screen. The beam paths are such that each beam impinges upon and excites only one kind of color-emitting phosphor on the screen. Generally, the shadow mask is attached to a rigid frame, which in turn, is suspended within the picture tube envelope.

Presently, all commercial color picture tubes have a front or viewing faceplate portion that is either spherical or cylindrical. However, it is desirable to develop a tube having a generally flat faceplate. According to prior art tube design concepts, in tubes having curved faceplates, the shadow mask is similarly curved so that it somewhat parallels the faceplate contour. Thus, in keeping with these prior art concepts, in a tube with a flat faceplate, the corresponding shadow mask should also have an almost flat contour. However, such a mask has insufficient self-supporting strength or rigidity. One way to provide this strength or rigidity would be to put the mask under tension as is done in some commercially available tubes having cylindrical faceplates. However, tension methods require undesirable and expensive frame structures. Another recently suggested way of providing strength to the mask is to corrugate it.

In the manufacture of more conventional tubes having spherical faceplates, another recent devleopment is to provide a shadow mask with greater curvature than that of the faceplate. Because of the increase in curvature, the thickness of the mask-frame assembly in the direction of the tube's longitudinal axis is increased thereby causing the frame to extend beyond the faceplate sidewalls. Such extension is undesirable since the mask-frame assembly is exposed to possible damage during manufacture. Therefore, it is desirable to develop a mask-frame assembly of reduced thickness. Suggested methods of accomplishing this reduction include telescoping the mask within the frame or distorting the mask skirt.

Embodiments of the present invention provide another way of obtaining a mask having high rigidity for use with a flat faceplate while other embodiments permit reduction in mask-frame assembly thickness for tubes with spherical faceplates.

SUMMARY OF THE INVENTION

A cathode-ray tube includes an improved shadow mask contoured with step risers therein separating active portions of the mask. The risers are aligned substantially parallel to deflected electron beam paths at corresponding points within the tube.

DESCRIPTION OF THE PREFERRED EMBODIMENTS

Figure 1:
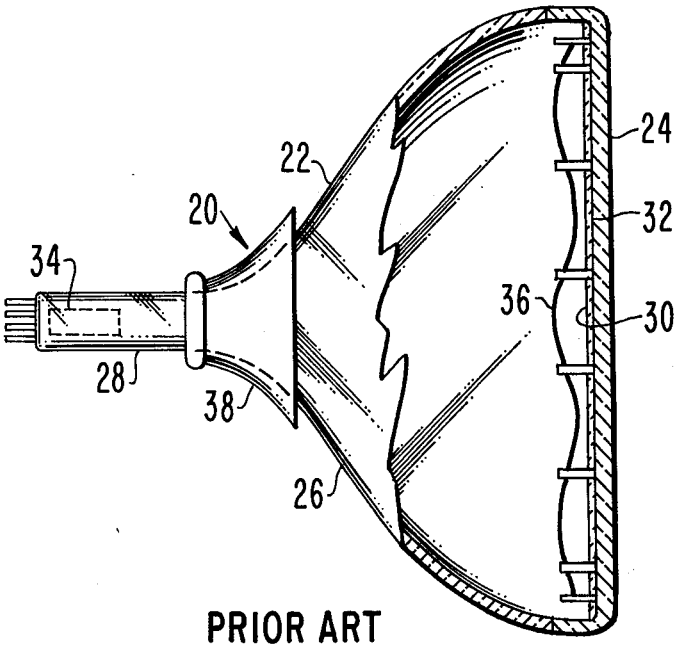
PRIOR ART Fig. 1.
FIG. 1 is a partially cut-away top view of a prior art cathode ray tube.

FIG. 1 illustrates a prior art apertured-mask color television picture tube 20 comprising an evacuated glass envelope 22. The envelope 22 includes a rectangularly-shaped flat faceplate panel 24, a funnel 26, and a neck 28. A three-color phosphor viewing-screen 30 is supported on the inner surface 32 of the faceplate panel 24. An electron-gun assembly 34, positioned in the neck 28, includes three electron guns, one for each of three color phosphors on the viewing-screen 30. A slit apertured mask 36 is positioned in the envelope 22 adjacent the viewing screen 30. The electron gun assembly 34 is adapted to project electrons from three electron beams through the apertured mask 36 to strike the viewing-screen structure 30, with the mask 36 serving as a color selection electrode. A magnetic deflection yoke 38 is positioned on the envelope 22 near the intersection of the funnel 26 and the neck 28. When suitably energized, the yoke 38 causes the electron beams to scan the screen 30 in a rectangular raster.

The apertured mask 36 is corrugated along the horizontal axis (in the direction of the larger dimension of the mask) with the corrugations extending vertically (between long sides of the mask or in the direction of the shorter dimension of the mask). The mask 36 has a plurality of elongated apertures aligned in parallel vertical columns (in the direction of the shorter mask dimension). The column-to-column spacing is varied with respect to the mask-to-screen spacing so that the phosphor elements on the screen are evenly packed.

Figure 2:
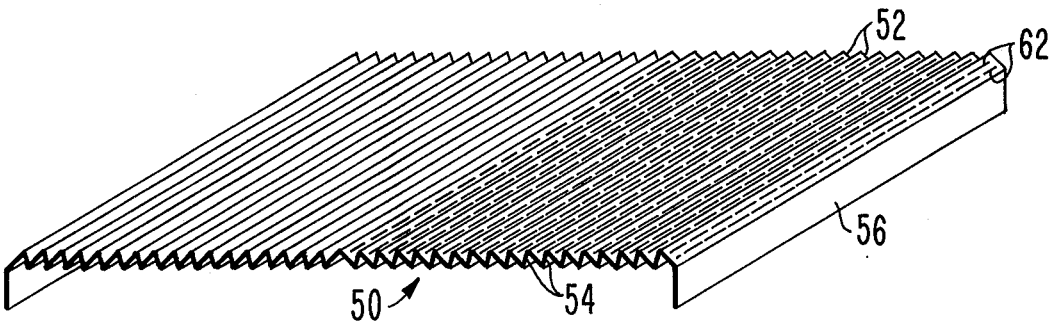
FIG. 2 is a perspective view of a shadow mask constructed in accordance with the present invention.

An improved shadow mask 50 for use in tubes having flat or substantially flat faceplates is shown in FIG. 2. The mask 50 comprises a plurality of strip-shaped apertured active portions 52 which perform the color selection function. The apertured active portions 52 are connected by unactive step riser portions 54 which are more inclined than the active portions 52, thereby forming a saw-tooth cross-sectional mask configuration. Each of the slits in the active portions are parallel to the lengthwise direction of the risers 54. The two straight sides of the mask 50 have skirt portions 56 extending therefrom. The plane of each step portion 54 is aligned substantially parallel to a deflected electron beam path at corresponding points on the mask.

Figure 3:
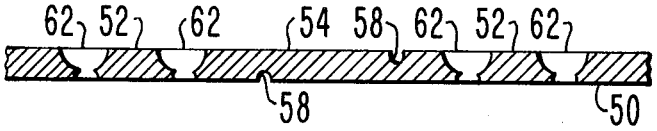
FIGS. 3 and 4 are cross-sectional views of a small portion of the mask of FIG. 2 before and after forming, respectively.
Figure 4:
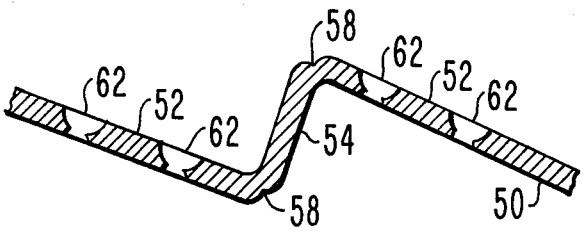
Figure 5:
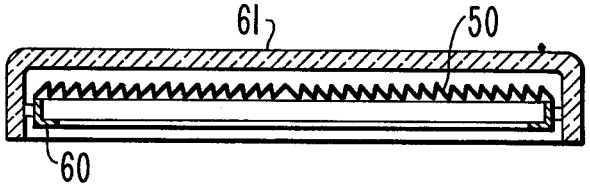
FIG. 5 is a cross-sectional side view of the mask of FIG. 2 mounted in a flat faceplate panel.

Construction techniques for fabricating the mask 50 may follow known prior art steps. First a photoresist material is applied to a sheet of the mask material and then the photoresist is exposed through a photomaster containing the desired pattern of apertures. Next, the photoresist is removed from the areas corresponding to aperture locations and the apertures are etched open. At this point, the flat mask appears as shown in FIG. 3. One variation in construction from prior art masks includes space to allow for the riser portions 54. Although the riser portions 54 are shown without apertures, the regular aperture pattern of the active portions 52 could be continued through the risers. Channels 58 are also included on each side of the mask at locations which are to be bent to form the steps or sawteeth of the final mask shape as shown in FIG. 4. When fabrication is completed, the mask 50 is attached to a peripheral reinforcing frame 60 and mounted in a flat faceplate panel 61 as shown in FIG. 5. The points on the mask 50 closest to the faceplate panel 61 substantially lie in a flat plane, as also shown in FIG. 5.

The apertures in the active portions 52 of the mask 50 are arranged in parallel columns 62 which will be oriented vertically in an operational tube. Preferably, the spacing between columns 62 in a particular active portion 52 is varied in relation to the mask to screen spacing so that uniform nesting of phosphor lines can be achieved.

Figure 6:
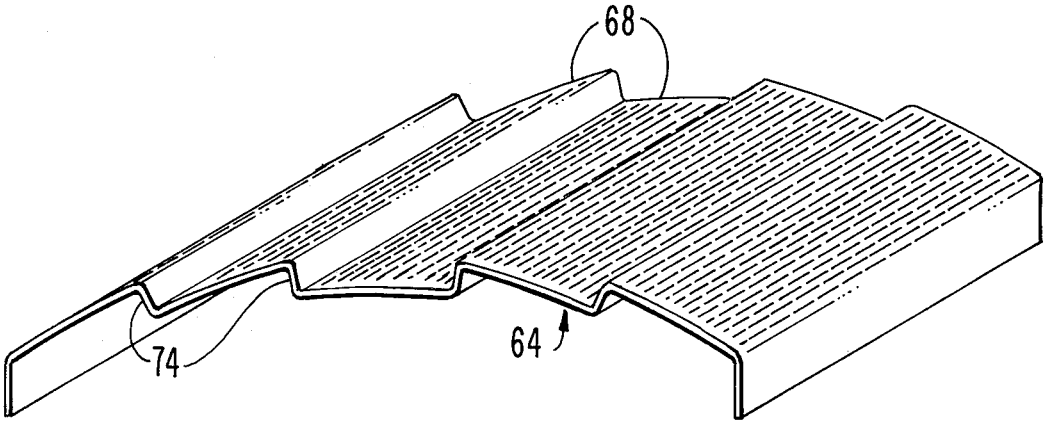
FIG. 6 is a perspective view of another shadow mask constructed in accordance with the present invention.
Figure 7:
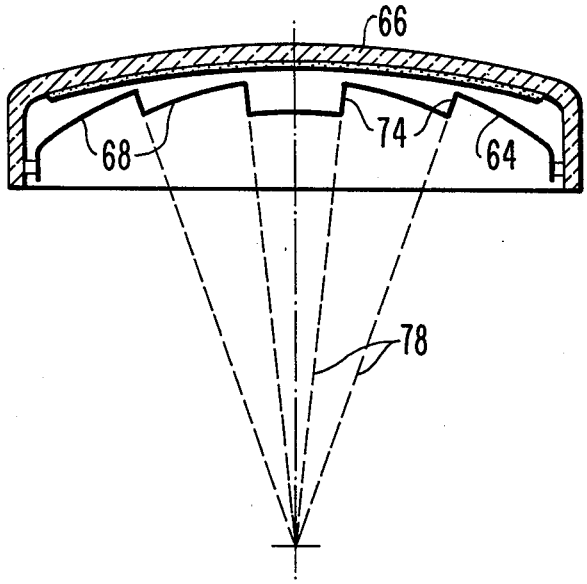
FIG. 7 is a cross-sectional view of the mask of FIG. 6 mounted in a cylindrical faceplate panel.
Figure 8:
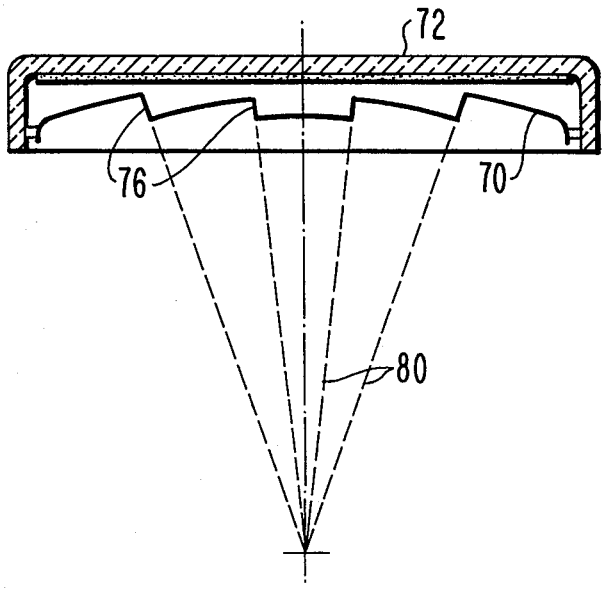
FIG. 8 is a cross-sectional side view of yet another mask mounted in a flat faceplate panel.

Another mask embodiment is illustrated in FIGS. 6 and 7. The mask 64 is provided with an overall curvature for use with a cylindrically curved faceplate 66. Each apertured active portion 68 of the mask 64 is also cylindrically curved, having a convex side and concave side, and is set back in a manner similar to that used in construction of a Fresnel lens. This mask 64 is the equivalent of a cylindrical mask having the same overall curvature as does each apertured active portion 68. A cross-sectional view of a similar type mask 70 only with an overall flatness for use with a flat faceplate 72, is shown in FIG. 8. Each active portion 73 of this mask 70 also is cylindrically curved. In both of these embodiments, the step riser portions 74 and 76, respectively, are aligned with the paths of electron beams 78 and 80 at the mask.

Figure 9:
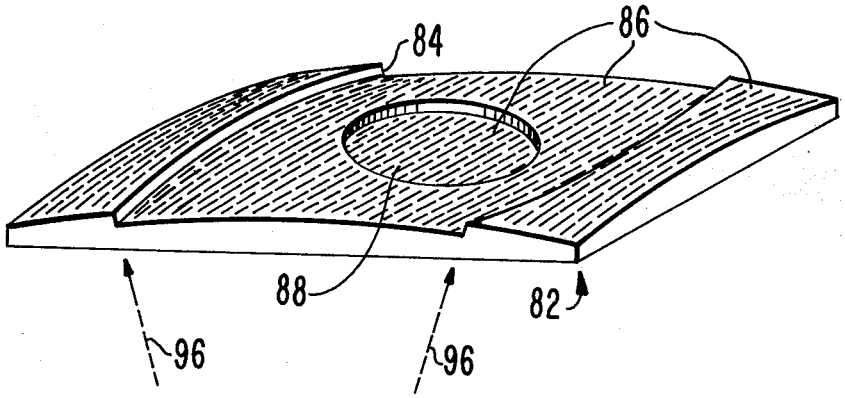
FIGS. 9 and 10 are perspective views of further mask embodiments in accordance with the present invention.
Figure 10:
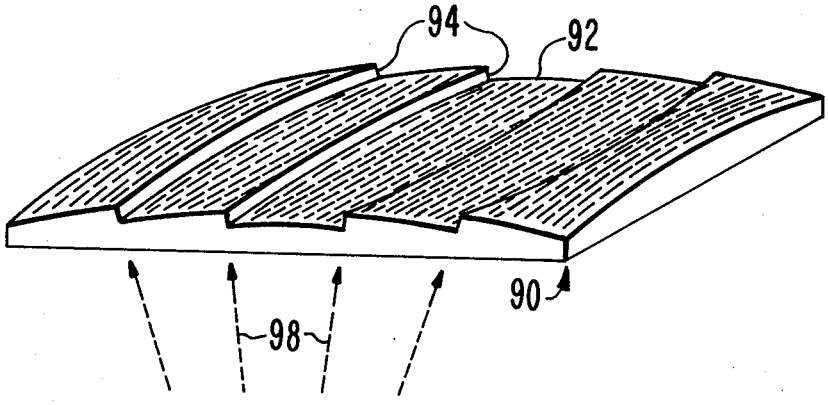

Two further mask embodiments are shown in FIGS. 9 and 10. The mask 82 of FIG. 9 has curved risers 84 separating spherically curved apertured active portions 86 of the mask to both reduce thickness and to provide a stronger more rigid mask. In the mask 82, the central active portion 88, which may be either circular as shown or some other shape such as elliptical, is surrounded by another apertured portion. The mask 90 of FIG. 10 has a similar surface curvature except that its central active portion 92 extends between two sides of the mask. Again, in both of these two embodiments, the riser portions 84 and 94, respectively, of each mask are aligned with the electron beam paths 96 and 98.

As can be seen in each of these embodiments, a curved mask, such as a spherical or cylindrical mask, can be compressed by using a construction method similar to that used to make Fresnel lenses. It should be noted that although each of the masks has greater curvature than their respective faceplate, both of the masks can be fully enclosed in the faceplate panel by use of this compression technique. Furthermore, the added contouring of the masks also provide them with added strength and rigidity.

We claim:

1. In a cathode-ray tube including an evacuated envelope, a color phosphor screen on the inner surface of said envelope, a multiapertured color selection shadow mask spaced from said screen, and electron gun means for generating and directing a plurality of electron beams along paths through said mask to said screen, the improvement comprising, said shadow mask having a plurality of apertured portions through which said electron beams pass and at least one other portion connecting the apertured portions through which said electron beams do not pass, said other portions being step risers aligned substantially parallel to electron beam paths at corresponding points within said tube, and said step risers offsetting adjacent apertured portions relative to said screen.

2. The tube as defined in claim 1, wherein all of said step risers extend lengthwise in a common direction.

3. The tube as defined in claim 1, wherein said risers are substantially flat sections of said mask.

4. The tube as defined in claim 1, wherein said risers are curved sections of said mask.

5. The tube as defined in claim 1, wherein the apertured portions of said masks are substantially flat.

6. The tube as defined in claim 1, wherein the major surfaces of the apertured portions of said mask are cylindrical in contour.

7. The tube as defined in claim 1, wherein the major surfaces of the apertured portions of said mask are spherical in contour.

8. The tube as defined in claim 1, wherein said risers offset at least one centrally located curved active portion of said mask away from said screen.

9. The tube as defined in claim 1, including a faceplate of said cathode-ray tube being substantially flat.

10. The tube as defined in claim 9, wherein points on said shadow mask closest to the faceplate substantially lie in a flat plane.

11. The tube as defined in claim 1, wherein said mask has a sawtooth horizontal cross-section with the more inclined portions of the sawtooth configuration being said risers.

12. The tube as defined in claim 11, wherein apertures in the apertured portions of said mask are slits which parallel the lengthwise direction of said risers.

13. In a cathode-ray tube including an evacuated envelope, a color phosphor screen on the inner surface of said envelope, a multiapertured color selection shadow mask spaced from said screen, and electron gun means for generating and directing a plurality of electron beams along paths through said mask to said screen, the improvement comprising, a compressed shadow mask having a plurality of apertured portions through which said electron beams pass and at least one other portion connecting the apertured portions through which said electron beams do not pass, said other portions being step risers aligned substantially parallel to electron beam paths at corresponding points within said tube, and in an edge-to-center direction of said mask, said aperture portions being successively offset away from said screen by said risers.

14. In a cathode-ray tube including an evacuated envelope, a color phosphor screen on the inner surface of said envelope, a multiapertured color selection shadow mask spaced from said screen, the apertures of said mask being aligned in parallel columns, and electron gun means for generating and directing a plurality of electron beams along paths through said mask to said screen, the improvement comprising, a plurality of aperture columns in one portion of said mask being offset relative to said screen from another plurality of aperture columns in another portion of said mask by a step in said mask.

15. The tube as defined in claim 14 including said step in said mask being aligned parallel with an electron beam path at the location of said step.

16. In a cathode-ray tube of the curved shadow mask type the improvement comprising, a shadow mask of said tube having a contour similar to the contour of a Fresnel lens, whereby portions of said mask are offset to provide a compressed mask.

* * * * *